US008237004B2

(12) United States Patent
Timken et al.

(10) Patent No.: US 8,237,004 B2
(45) **Date of Patent: *Aug. 7, 2012**

(54) PROCESS FOR MAKING PRODUCTS WITH LOW HYDROGEN HALIDE

(75) Inventors: Hye-Kyung Timken, Albany, CA (US); Christine Phillips, Pleasant Hill, CA (US); Robert F. Cleverdon, Walnut Creek, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 261 days.

This patent is subject to a terminal disclaimer.

(21) Appl. No.: 12/650,816

(22) Filed: Dec. 31, 2009

(65) Prior Publication Data

US 2011/0155632 A1 Jun. 30, 2011

(51) Int. Cl.
*C07C 7/04* (2006.01)
*C10G 7/00* (2006.01)
*C10L 1/06* (2006.01)

(52) U.S. Cl. ..... 585/800; 208/16; 208/17; 208/262.1; 208/347

(58) Field of Classification Search ..... 208/16, 208/17, 347, 262.1
See application file for complete search history.

(56) References Cited

U.S. PATENT DOCUMENTS 4,956,076 A * 9/1990 Awbrey ..... 208/291
5,565,617 A 10/1996 Schmidt et al.
7,342,143 B2 * 3/2008 Birke et al. ..... 585/250
7,432,408 B2 10/2008 Timken et al.
7,432,409 B2 10/2008 Elomari et al.
7,495,144 B2 2/2009 Elomari
7,531,707 B2 * 5/2009 Harris et al. ..... 585/721
7,538,256 B2 5/2009 Driver et al.
7,601,255 B2 * 10/2009 Kosover et al. ..... 208/262.1
7,956,230 B2 * 6/2011 Timken et al. ..... 585/712
7,988,747 B2 * 8/2011 Lacheen et al. ..... 44/304
(Continued)

FOREIGN PATENT DOCUMENTS

FR 2862059 5/2005
(Continued)

OTHER PUBLICATIONS

PCT/US2010/056379 Notification of Transmittal of the International Search Report and the Written Opinion of the International Searching Authority, or the Declaration, 12 pages, Jul. 18, 2011.

*Primary Examiner* — Ellen McAvoy
(74) *Attorney, Agent, or Firm* — Susan M. Abernathy

(57) ABSTRACT

A process for making products with low hydrogen halide, comprising: a) stripping or distilling an effluent from a reactor into a first fraction having an amount of hydrogen halide, and a second fraction having a reduced amount of hydrogen halide; wherein the reactor comprises: an ionic liquid catalyst having a metal halide, and a hydrogen halide or an organic halide; and b) recovering one or more product streams, from the second fraction, having less than 25 wppm hydrogen halide. In one embodiment the ionic liquid catalyst has metal halide; and the recovering recovers propane, n-butane, and alkylate gasoline having less than 25 wppm hydrogen halide. In another embodiment the recovering uses a distillation column having poor corrosion resistance to hydrogen halide; and the distillation column does not exhibit corrosion. There is also provided an alkylate gasoline having less than 5 wppm hydrogen halide, a high RON, and low RVP.

30 Claims, 2 Drawing Sheets

U.S. PATENT DOCUMENTS

| | | | | |
|---|---|---|---|---|
| 2005/0010076 | A1 | 1/2005 | Wasserscheid et al. | |
| 2008/0015369 | A1 | 1/2008 | Kruper, Jr. et al. | |
| 2009/0105514 | A1 | 4/2009 | Lee et al. | |
| 2009/0163750 | A1 | 6/2009 | Timken et al. | |
| 2009/0163759 | A1* | 6/2009 | Driver et al. | 585/826 |
| 2010/0025292 | A1 | 2/2010 | Hommeltoft et al. | |
| 2010/0065476 | A1 | 3/2010 | Hommeltoft et al. | |
| 2011/0155640 | A1* | 6/2011 | Timken et al. | 208/97 |

FOREIGN PATENT DOCUMENTS

| | | |
|---|---|---|
| WO | WO 2009/079107 | 6/2009 |

* cited by examiner

PROCESS FOR MAKING PRODUCTS WITH LOW HYDROGEN HALIDE

This application is related to a co-filed application, titled "A PROCESS FOR RECYCLING HYDROGEN HALIDE TO A REACTOR COMPRISING AN IONIC LIQUID," fully incorporated herein.

FIELD OF THE INVENTION

This application is directed to processes for making products with low hydrogen halide by stripping or distilling an effluent from a reactor comprising an ionic liquid catalyst. This application is also directed to an alkylate gasoline made by a process of this application.

SUMMARY OF THE INVENTION

This application provides a process for making products with low hydrogen halide, comprising:

a) stripping or distilling an effluent from a reactor into a first fraction having an amount of a hydrogen halide, and a second fraction having a reduced amount of the hydrogen halide less than the first fraction; wherein the reactor comprises:
   i. an ionic liquid catalyst having a metal halide, and
   ii. the hydrogen halide or an organic halide; and
b) recovering one or more product streams, from the second fraction, having less than 25 wppm of the hydrogen halide.

This application also provides a process for making products with low hydrogen halide, comprising:

a) stripping or distilling an effluent from a reactor into a first fraction having an increased amount of a hydrogen halide, and a second fraction having a reduced amount of the hydrogen halide; wherein the reactor comprises an ionic liquid catalyst having a metal halide; and
b) recovering a propane, an n-butane, and an alkylate gasoline from the second fraction all having less than 25 wppm of the hydrogen halide.

This application also provides a process for making products with low hydrogen halide, comprising:

a) stripping or distilling an effluent from a reactor into a first fraction having an increased amount of a hydrogen halide, and a second fraction having a reduced amount of the hydrogen halide; wherein the reactor comprises:
   i. an ionic liquid catalyst having a metal halide, and
   ii. a hydrogen halide or an organic halide; and
b) recovering one or more product streams, from the second fraction, using a distillation column made with one or more metals having poor corrosion resistance to the hydrogen halide; and wherein the distillation column does not exhibit corrosion from the recovering.

This application also provides an alkylate gasoline having a low level of hydrogen halide, made by a process comprising:

a) stripping or distilling an effluent from a reactor into a first fraction having an amount of a hydrogen halide, and a second fraction having a reduced amount of the hydrogen halide less than the first fraction; wherein the reactor comprises:
   i. an ionic liquid catalyst having a metal halide, and
   ii. a hydrogen halide or an organic halide; and
b) recovering an alkylate gasoline comprising less than 5 wppm hydrogen halide directly from the second fraction.

DETAILED DESCRIPTION OF THE INVENTION

Figure 1:
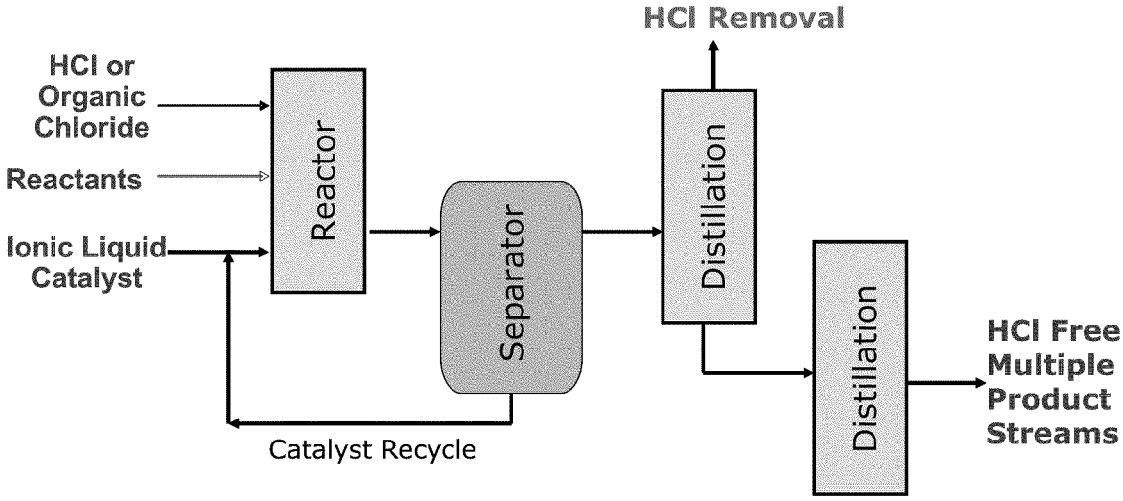
FIG. 1 is a process flow diagram of an embodiment showing removal of HCl in a hydrocarbon process stream.

Hydrogen halides are acids resulting from the chemical reaction of hydrogen with one of the halogen elements (fluorine, chlorine, bromine, iodine, astatine and ununseptium), which are found in Group 17 of the periodic table. Astatine is very rare, unstable and not found as the acid in substantial quantities; ununseptium has never been synthesized. Hydrogen halides can be abbreviated as HX where H represents a hydrogen atom and X represents a halogen (fluorine, chlorine, bromine or iodine). The boiling points of the most common hydrogen halides are listed below:

| | |
|---|---|
| HF | 19° C. |
| HCl | −85° C. |
| HBr | −67° C. |
| HI | −35° C. |

Because of their relatively low boiling points, hydrogen halides are compounds that can be separated from other hydrocarbons by distilling or stripping. It is desired that levels of hydrogen halides be kept at a minimum in many finished products.

In the context of this disclosure, 'an increased amount' is at least 5 ppm higher than an initial amount. 'A reduced amount' is at least 5 ppm lower than an initial amount, or at least 5 ppm lower than the amount in the first fraction.

Stripping is the removal of volatile components from a liquid by vaporization. In stripping processes, the solution from the separation step must be stripped in order to permit recovery of the separated hydrocarbons and recycle of the lighter gases. Stripping may be accomplished by pressure reduction, the application of heat, or the use of an inert gas or hydrogen gas (stripping vapor). Some processes may employ a combination of all three; that is, after separation, the hydrocarbon products are flashed to atmospheric pressure, heated, and admitted into a stripping column which is provided with a bottom heater (reboiler). Solvent vapor generated in the reboiler or inert gas injected at the bottom of the column serves as stripping vapor which rises countercurrently to the downflowing of hydrocarbon products.

Distilling is the extraction of the volatile components of a mixture by the condensation and collection of the vapors that are produced as the mixture is heated. Distilling is described in Section 13 of *Perry's Chemical Engineer's Handbook* ($8^{th}$ *Edition*), by Don W. Green and Robert H. Perry, © 2008 McGraw-Hill, pages 13-1 to 13-79. In one embodiment the distillation is performed in a distillation column at a pressure between 50 and 500 psig. In one embodiment, the bottom temperature in a distillation column is between 10 and 204° C. (50 and 400° F.). In one embodiment, the overhead temperature in a distillation column is between 38 and 316° C. (100 and 600° F.). In one embodiment, the distillation is performed with reflux. Reflux is a technique, using a reflux condenser, allowing one to boil the contents of a vessel over an extended period. The distillation conditions are selected to provide the first fraction having an increased amount of the hydrogen halide and the second fraction having a reduced amount of the hydrogen halide. The distillation conditions are adjusted to obtain desired levels of hydrogen halide in each fraction. In one embodiment, the level of hydrogen halide in the first fraction is at least 5 wt %. In another embodiment, the level of hydrogen halide in the second fraction is less than 25 wppm.

For maximum recovery of the hydrogen halide, distilling would more likely be employed. If maximum recovery of the hydrogen halide is not as critical, then stripping might be more desirable, to lower the equipment cost.

The reactor may be any design suitable for achieving a desired hydrocarbon conversion. Examples of hydrogen conversions for which the reactor is used for include paraffin alkylation, olefin dimerization, olefin oligomerization, isomerization, aromatic alkylation, and mixtures thereof. Examples of reactors include stirred tank reactors, which can be either a batch reactor or a continuously stirred tank reactor (CSTR). Alternatively, a batch reactor, a semi-batch reactor, a riser reactor, a tubular reactor, a loop reactor, a continuous reactor, a static mixer, a packed bed contactor, or any other reactor and combinations of two or more thereof can be employed. Specific examples of alkylation reactors comprising ionic liquid catalysts that are useful for paraffin alkylation are described in US 2009-0166257 A1, US 2009-0171134 A1, and US 2009-0171133 A1.

In one embodiment the reactor comprises an ionic liquid catalyst having a metal halide, and a hydrogen halide or an organic halide. In another embodiment the reactor comprises an ionic liquid catalyst having a metal halide. Examples of metal halides are $AlCl_3$, $AlBr_3$, $GaCl_3$, $GaBr_3$, $InCl_3$, $InBr_3$, and mixtures thereof. In one embodiment the hydrogen halide is anhydrous HCl. In one embodiment the metal halide is aluminum chloride and the hydrogen halide is hydrogen chloride (HCl). In some embodiments, excess amounts of anhydrous HCl are needed to ensure extended operation of a catalytic process.

The effluent from the reactor comprises a level of hydrogen halide that is higher than what is desired in a product stream. The hydrogen halide is derived from one or more of the metal halide, the hydrogen halide, or the organic halide that are present in the reactor.

The one or more product streams that are recovered have an acceptable level of hydrogen halide. In some embodiments they have less than 25 wppm of the hydrogen halide. In other embodiments they have less than 20, less than 10, less than 5, less than 2, or less than 1 wppm of the hydrogen halide. In some embodiments, the one or more product streams have less than 25 wppm, less than 20, less than 10, less than 5, less than 2, or even less than 1 wppm of the hydrogen halide prior to any optional caustic treating. Because the one or more product streams have such low amounts of hydrogen halide, little to no caustic treating of the products is needed, which reduces process complexity and cost.

The one or more product streams comprise hydrocarbons. In one embodiment the one or more product streams comprise a propane, butane, an alkylate gasoline, and mixtures thereof; and all of them have less than 25 wppm of the hydrogen halide. Other product streams may include middle distillate, jet fuel, and base oil. In other embodiments, all of the one or more product streams have less than 10 wppm, less than 5 wppm, less than 2 wppm, or less than 1 wppm. Alkylate gasoline is the isoparaffin reaction product of butylene or propylene or ethylene or pentene with isobutane, or the isoparaffin reaction product of ethylene or propylene or butylenes with isopentane. In some embodiments the alkylate gasoline has high octane value and can be blended with motor and aviation gasoline to improve the antiknock value of the fuel.

In one embodiment, an alkylate gasoline having less than 5 wppm hydrogen halide is recovered directly from the second fraction. No further processing of the alkylate gasoline is required to obtain this low level of hydrogen halide. In other embodiments, the alkylate gasoline that is recovered from the second fraction has less than 2 wppm or less than 1 wppm hydrogen halide.

In one embodiment, the alkylate gasoline recovered from the second fraction has a low volatility. In one embodiment the alkylate gasoline has a Reid Vapor Pressure (RVP) less than 2.8 psi (19.31 kPa). In other embodiments the alkylate gasoline has a RVP of 2.2 psi (15.2 kPa) or less, or less than the amount defined by the equation: RVP=−0.035×(50 vol % boiling point, ° C.)+5.8, in psi. The chart of this equation is shown in FIG. 1 in U.S. patent application Ser. No. 12/184,109, filed on Jul. 31, 2008. To convert psi to kPa, multiply the result by 6.895.

In one embodiment, the alkylate gasoline has a high octane number. Examples of high octane numbers are 82 or higher, greater than 85, greater than 90, and greater than 95. Different methods are used for calculating octane numbers of fuels or fuel blend components. The Research-method octane number (RON) is determined using ASTM D 2699-07a. RON employs the standard Cooperative Fuel Research (CFR) knock-test engine. Additionally, the Research-method octane number may be calculated [RON (GC)] from gas chromatography boiling range distribution data. The RON (GC) calculation is described in the publication, Anderson, P. C., Sharkey, J. M., and Walsh, R. P., "Journal Institute of Petroleum", 58 (560), 83 (1972).

Alkylation processes for making alkylate gasoline with low volatility and high octane number are described in U.S. Pat. No. 7,432,408 and U.S. patent application Ser. No. 12/184,109, filed on Jul. 31, 2008.

The ionic liquid catalyst is composed of at least two components which form a complex. The ionic liquid catalyst comprises a first component and a second component. The first component of the catalyst may comprise a Lewis Acid selected from components such as Lewis Acidic compounds of Group 13 metals, including aluminum halides, alkyl aluminum halide, gallium halide, and alkyl gallium halide (see International Union of Pure and Applied Chemistry (IUPAC), version3, October 2005, for Group 13 metals of the periodic table). Other Lewis Acidic compounds, in addition to those of Group 13 metals, may also be used. In one embodiment the first component is aluminum halide or alkyl aluminum halide. For example, aluminum trichloride may be the first component of the acidic ionic liquid catalyst.

The second component making up the acidic ionic liquid catalyst is an organic salt or mixture of salts. These salts may be characterized by the general formula Q+A−, wherein Q+ is an ammonium, phosphonium, boronium, iodonium, or sulfonium cation and A− is a negatively charged ion such as Cl—, Br—, $ClO_4^-$, $NO_3^-$, $BF_4^-$, $BCl_4^-$, $PF_6^-$, $SbF_6^-$, $AlCl_4^-$, $TaF_6^-$, $CuCl_2^-$, $FeCl_3^-$, $HSO_3^-$, $RSO_3^-$, $SO_3CF_3^-$, and 3-sulfurtrioxyphenyl. In one embodiment the second component is selected from those having quaternary ammonium halides containing one or more alkyl moieties having from about 1 to about 12 carbon atoms, such as, for example, trimethylamine hydrochloride, methyltributylammonium halide, or substituted heterocyclic ammonium halide compounds, such as hydrocarbyl substituted pyridinium halide compounds for example 1-butylpyridinium halide, benzylpyridinium halide, or hydrocarbyl substituted imidazolium halides, such as for example, 1-ethyl-3-methyl-imidazolium chloride.

In one embodiment the ionic liquid catalyst is selected from the group consisting of hydrocarbyl substituted pyridinium chloroaluminate, hydrocarbyl substituted imidazolium chloroaluminate, quaternary amine chloroaluminate, trialky amine hydrogen chloride chloroaluminate, alkyl pyridine hydrogen chloride chloroaluminate, and mixtures thereof. For example, the ionic liquid catalyst can be an acidic haloaluminate ionic liquid, such as an alkyl substituted pyridinium chloroaluminate or an alkyl substituted imidazolium chloroaluminate of the general formulas A and B, respectively.

A

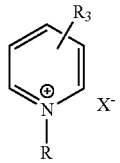

B

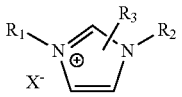

In the formulas A and B; R, $R_1$, $R_2$, and $R_3$ are H, methyl, ethyl, propyl, butyl, pentyl or hexyl group, X is a chloroaluminate. In the formulas A and B, R, $R_1$, $R_2$, and $R_3$ may or may not be the same. In one embodiment the ionic liquid catalyst is N-butylpyridinium chloroaluminate.

In another embodiment the ionic liquid catalyst can have the general formula $RR'R''NH^+Al_2Cl_7^-$, wherein N is a nitrogen containing group, and wherein RR' and R" are alkyl groups containing 1 to 12 carbons, and where RR' and R" may or may not be the same.

The presence of the first component should give the ionic liquid a Lewis or Franklin acidic character. Generally, the greater the mole ratio of the first component to the second component, the greater is the acidity of the ionic liquid catalyst.

In one embodiment, the ionic liquid catalyst is mixed in the reactor with a hydrogen halide or an organic halide. The hydrogen halide or organic halide can boost the overall acidity and change the selectivity of the ionic liquid catalyst. The organic halide may be an alkyl halide. The alkyl halides that may be used include alkyl bromides, alkyl chlorides, alkyl iodides, and mixtures thereof. A variety of alkyl halides may be used. Alkyl halide derivatives of the isoparaffins or the olefins that comprise the feed streams in the alkylation process are good choices. Such alkyl halides include, but are not limited to, iospentyl halides, isobutyl halides, butyl halides, propyl halides and ethyl halides. Other alkyl chlorides or halides having from 1 to 8 carbon atoms may be also used. The alkyl halides may be used alone or in combination. The use of alkyl halides to promote hydrocarbon conversion by ionic liquid catalysts is taught in U.S. Pat. No. 7,495,144 and in U.S. patent application Ser. No. 12/468,750, filed May 19, 2009.

It is believed that the alkyl halide decomposes under hydroconversion conditions to liberate Bronsted acids or hydrogen halides, such as hydrochloric acid (HCl) or hydrobromic acid (HBr). These Bronsted acids or hydrogen halides promote the hydrocarbon conversion reaction. In one embodiment the halide in the hydrogen halide or alkyl halide is the same as a halide component of the ionic liquid catalyst. In one embodiment the alkyl halide is an alkyl chloride. A hydrogen chloride or an alkyl chloride may be used advantageously, for example, when the ionic liquid catalyst is a chloroaluminate.

In one embodiment, at least a portion of the first fraction having an increased amount of the hydrogen halide is recycled back to the reactor. For example, the process can further comprise the step of recycling at least a portion or all of the first fraction back to the reactor. By recycling the hydrogen halide, less (or no) additional hydrogen halide or organic halide is required to be fed to the reactor. Alternatively, at least a portion of the first fraction having an increased amount of the hydrogen halide is treated with a caustic solid or an aqueous caustic solution. Because the first fraction has a higher concentration of hydrogen halide, it is easier and less expensive to treat than the entire effluent from the reactor, or a hydrocarbon phase that is separated from the effluent.

In one embodiment, the one or more product streams comprise one or more isoparaffins that are recycled back to the reactor. For example, the process can further comprise the step of recycling the one or more isoparaffins back to the reactor. The isoparaffins may be the same as the reactants that were originally fed to the reactor. Processes for recycling isoparaffin to a reactor comprising an ionic liquid catalyst is described in US Patent Publication US20090171133. Among other factors, recycling of isoparaffins to the reactor provides a more efficient alkylation and/or oligomerization process when using an ionic liquid catalyst. The recycling of isoparaffins allows the reaction in the presence of the ionic liquid catalyst to maintain a more effective ratio of isoparaffin to olefin (I/O). Having the correct I/O is essential to minimize undesired side reactions. One can also use a lower quality of feed while maintaining a desired I/O within the reactor.

In one embodiment, the effluent from the reactor is separated into a hydrocarbon phase and a catalyst phase, and the stripping or distilling is performed on the hydrocarbon phase.

The stripping or distilling of the effluent may be done once or in a series of stripping or distilling steps. In one embodiment, the process comprises a single step of stripping or distilling. The costs of equipment and energy are reduced in the embodiment where the stripping or distilling is only done once. Embodiments where the stripping or distilling is done once, do not exclude processes where portions of the first or second fraction are recycled back to the reactor.

In one embodiment, the recovering is done in process equipment having poor corrosion resistance to HCl. For example the process equipment may be made with one or more metals that have poor corrosion resistance to HCl and wherein the process equipment does not exhibit corrosion from the recovering. Examples of process equipment that may be used for recovering include strippers, flash drums, distillation columns, piping, valves, trays, plates, random or structured packings, coalescers, screens, filters, fractionators, dividing walls, absorbers, etc. Metals that have poor corrosion resistance to HCl include aluminum, carbon steel, cast iron, stainless steel, bronze, and Durimet® alloys. In one embodiment the one or more metals having poor corrosion resistance to the hydrogen halide comprise a carbon steel, a stainless steel, or a mixture thereof. These metals are less expensive and more readily available than metals that have better corrosion resistance to HCl, such as Hastelloy® alloys, Monel® alloys, Carpenter® alloys, tantalum, titanium, or cobalt-based alloys. DURIMET is a registered trademark of Flowserve Corporation. HASTELLOY is a registered trade name of Haynes International, Inc. MONEL is a registered trade name of the INCO family of companies. CARPENTER is a registered trade name of Carpenter Technology Corporation. Information on materials that are more or less resistant to corrosion by HCl are described in the *Kirk-Othmer Encyclopedia of Chemical Technology* (John Wiley & Sons, Inc.), DOI: 10.1002/0471238961.0825041808091908.a01.pub2. Article Online Posting Date: Dec. 17, 2004.

Carbon steel is steel where the main alloying constituent is carbon. Steel is considered to be carbon steel when no minimum content is specified or required for chromium, cobalt, columbium, molybdenum, nickel, titanium, tungsten, vanadium or zirconium, or any other element to be added to obtain a desired alloying effect; when the specified minimum for copper does not exceed 0.40 percent; or when the maximum content specified for any of the following elements does not exceed the percentages noted: manganese 1.65, silicon 0.60, and copper 0.60.

Stainless steel is a steel alloy with a minimum of 10.5 or 11% chromium content by mass. Stainless steel does not stain, corrode, or rust as easily as ordinary steel. There are different grades and surface finishes of stainless steel to suit the environment to which the material will be subjected in its lifetime. Stainless steel differs from carbon steel by the amount of chromium present. Carbon steel rusts when exposed to air and moisture. This iron oxide film (the rust) is active and accelerates corrosion by forming more iron oxide. Stainless steels have sufficient amounts of chromium present so that a passive film of chromium oxide forms which prevents further surface corrosion when exposed to air and moisture, and the passive film blocks corrosion from spreading into the metal's internal structure.

In one embodiment the recovering uses a distillation column made with one or more metals having poor corrosion resistance to the hydrogen halide, and the distillation column does not exhibit corrosion from the recovering. Examples of these metals are carbon steel, stainless steel, and mixtures thereof. Evidence of when the distillation column or process equipment do not exhibit corrosion are when the metal penetration is less than 10 mil/year, where 1 mil=0.001 inch. In one embodiment the process equipment has less than 10 mil/year penetration.

The hydrogen halide concentration in the one or more product streams, the first fraction, the second fraction, or portions thereof can be measured by any method that is accurate in the range of the concentration of the hydrogen halide. For gas streams, the following test methods are appropriate: (1) using a DRAEGER TUBE™ with a pre-calibrated hydrogen halide selective probe, (2) using an on-line hydrogen halide measurement device, or (3) via acid/base titration with a standard caustic solution with a known concentration. DRAEGER TUBE™ is a registered trademark of Draeger Safety Inc. For liquid streams the hydrogen halide can be measured by titration using a standard caustic solution with a known concentration.

The following is a description of an embodiment of the process with reference to FIG. 1:

Hydrogen chloride or organic chloride, reactants, and an ionic liquid catalyst are fed to a reactor. Effluents from the reactor are passed through a separator, which separates the effluent into a hydrocarbon phase and a catalyst phase. At least a portion of the catalyst phase is recycled back to the ionic liquid catalyst being fed to the reactor. At least a portion of the hydrocarbon phase is fed to a distillation column. The distillation column distills the effluent from the reactor into a first fraction having essentially all of the hydrogen chloride and a second fraction that has essentially no hydrogen chloride. The second fraction is then further distilled to recover multiple product streams that are free of hydrogen chloride.

Figure 2:
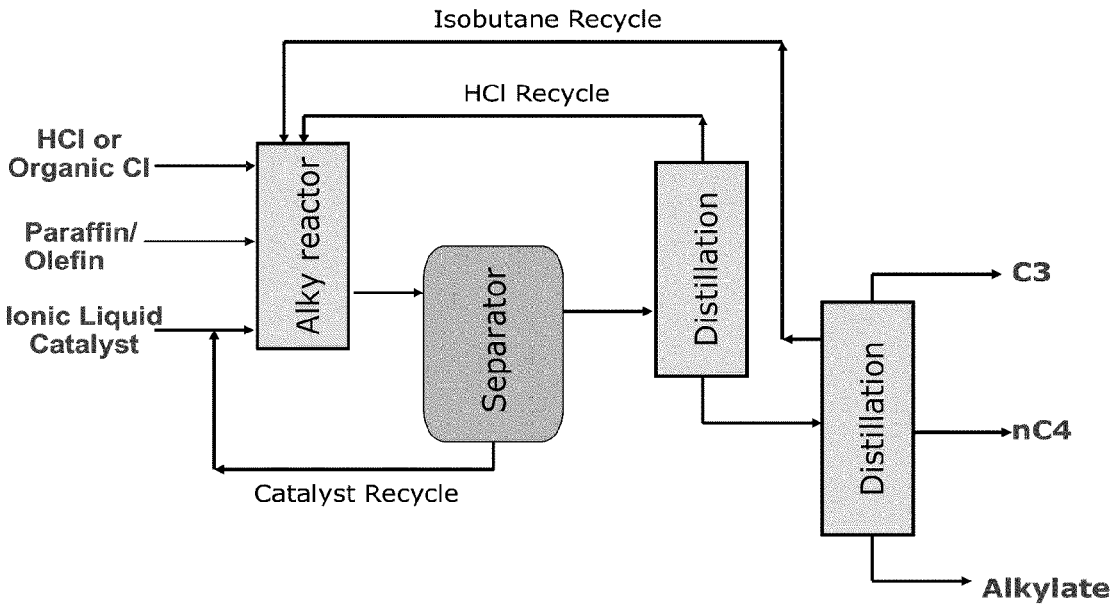
FIG. 2 is a process flow diagram of an embodiment showing recycling of HCl and anhydrous isobutane for paraffin alkylation.

The following is a description of an embodiment of the process with reference to FIG. 2:

Hydrogen chloride or organic chloride, reactants comprising one or more paraffins and one or more olefins, and an ionic liquid catalyst are fed to an alkylation reactor. Effluents from the alkylation reactor are passed through a separator, which separates the effluent into a hydrocarbon phase and a catalyst phase. At least a portion of the catalyst phase is recycled back to the ionic liquid catalyst being fed to the alkylation reactor. At least a portion of the hydrocarbon phase is fed to a distillation column. The distillation column distills the effluent from the reactor into a first fraction having essentially all of the hydrogen chloride and a second fraction that has essentially no hydrogen chloride. At least a portion of the first fraction is fed back to the alkylation reactor. The second fraction is then further distilled to recover multiple product streams that are free of hydrogen chloride, and an anhydrous isobutane stream that is recycled back to the alkylation reactor. The multiple product streams that are free of hydrogen chloride comprise methane, n-butane, and alkylate gasoline.

For the purposes of this specification and appended claims, unless otherwise indicated, all numbers expressing quantities, percentages or proportions, and other numerical values used in the specification and claims, are to be understood as being modified in all instances by the term "about." Furthermore, all ranges disclosed herein are inclusive of the endpoints and are independently combinable. Whenever a numerical range with a lower limit and an upper limit are disclosed, any number falling within the range is also specifically disclosed.

Any term, abbreviation or shorthand not defined is understood to have the ordinary meaning used by a person skilled in the art at the time the application is filed. The singular forms "a," "an," and "the," include plural references unless expressly and unequivocally limited to one instance.

All of the publications, patents and patent applications cited in this application are herein incorporated by reference in their entirety to the same extent as if the disclosure of each individual publication, patent application or patent was specifically and individually indicated to be incorporated by reference in its entirety.

This written description uses examples to disclose the invention, including the best mode, and also to enable any person skilled in the art to make and use the invention. Many modifications of the exemplary embodiments of the invention disclosed above will readily occur to those skilled in the art. Accordingly, the invention is to be construed as including all structure and methods that fall within the scope of the appended claims. Unless otherwise specified, the recitation of a genus of elements, materials or other components, from which an individual component or mixture of components can be selected, is intended to include all possible sub-generic combinations of the listed components and mixtures thereof.

EXAMPLES

Example 1

A sample of N-butylpyridinium chloroaluminate ($C_5H_5C_4H_9Al_2Cl_7$) ionic liquid catalyst was analyzed and had the following elemental composition. The ionic liquid catalyst had aluminum chloride as the metal halide.

| | |
|---|---|
| Wt % Al | 12.4 |
| Wt % Cl | 56.5 |
| Wt % C | 24.6 |
| Wt % H | 3.2 |
| Wt % N | 3.3 |

Example 2

The ionic liquid catalyst described in Example 1 was used to alkylate $C_3$ and $C_4$ olefins with isobutane. The alkylation was performed in a continuously stirred tank reactor (CSTR). An 8:1 molar ratio of isobutane to total olefin mixture was fed to the reactor via a first inlet port while vigorously stirring. The ionic liquid catalyst was fed to the reactor via a second inlet port, targeting to occupy 7 vol % in the reactor. A small amount of anhydrous HCl gas was added to the ionic liquid catalyst in the reactor. The average residence time of the combined feeds (isobutane/olefin mixture and catalyst) in the reactor was about eight minutes. The outlet pressure was maintained at 200 psig and the reactor temperature was maintained at 15.6° C. (60° F.) using external cooling. The reactor effluent was separated with a gravity separator into a hydrocarbon phase and an ionic liquid catalyst phase.

The separated hydrocarbon phase was sent to a distillation column operating at 245 psig, 99° C. (210° F.) bottom temperature and 49° C. (120° F.) overhead temperature, with reflux. The overhead stream was rich in HCl, up to 15 wt % HCl, and the remainder was mainly propane. The HCl-rich overhead stream was sent back to the reactor for further use. The bottom stream was nearly HCl-free, showing less than a 10 ppm HCl concentration. The essentially HCl-free hydrocarbon bottom stream was sent to further distillation to generate an isobutane recycle stream as well as propane, n-butane, and alkylate gasoline product streams. The propane, n-butane, and alkylate gasoline product streams contained no measurable HCl, showing less than 5 ppm HCl. This process scheme is desirable since HCl is concentrated only for the 1$^{st}$ distillation column, thus any corrosion concerns for the subsequent distillation columns are eliminated. By recycling the HCl enriched propane stream back to the reactor, the HCl material cost and handling hazards are minimized.

Example 3

Comparative Example, Reduction of HCl Using Caustic Treating

Reactor effluent from Example 2 was treated with 8 wt % NaOH caustic solution in a stirred tank reactor at process conditions of 3:1 hydrocarbon to caustic solution volume ratio, room temperature (60° F.), 15 minute average residence time and vigorous stirring. The resulting hydrocarbon and caustic solution mixture was then separated by gravity in a settler. The hydrocarbon phase was sent to the distillation column to produce propane, n-butane and alkylate gasoline product streams and isobutane recycle stream. All these streams contained no measurable HCl, showing less than 5 ppm HCl. However, with this process the HCl is consumed and cannot be recycled back to the reactor. Also the isobutane recycle stream is now saturated with water, thus needing thorough drying before sending back to the reactor for reuse. These additional steps may make the process operation more costly, and also there are corrosion concerns for the caustic treatment equipment.

Example 4

Recycle of HCl Using Cascade Distillation

Reactor effluent from Example 2 was sent to a series of distillation columns to separate the hydrocarbon streams first. The distillation columns operated at 38-149° C. (100-300° F.) bottom temperatures, 10-93° C. (50-200° F.) overhead temperatures, and 100-200 psig pressure. The resulting alkylate stream contained no measurable HCl, showing less than 5 ppm HCl. The butane stream also contained no measurable HCl, showing less than 5 ppm HCl. The recycle isobutane stream contained some HCl up to a few hundred ppm depending on the operating conditions. The propane stream was enriched with over 1000 ppm HCl. By adding another distillation column for the propane stream, the HCl was enriched in the overhead to around 15 wt % HCl and the remainder was mainly propane. This HCl enriched stream is recycled back to the reactor. This HCl and isobutane recycle process is workable. However, all distillation columns are now exposed to HCl gas and this generates concerns for corrosion.

It is claimed:

1. A process for making hydrocarbon products with low hydrogen halide, comprising:

a) stripping or distilling an effluent from a reactor into a first fraction having an amount of a hydrogen halide, and a second fraction having a reduced amount of the hydrogen halide less than the first fraction; wherein the stripping is a removal of volatile components from the effluent by vaporization; wherein the reactor comprises:
   i. an ionic liquid catalyst having a metal halide, and
   ii. the hydrogen halide or an organic halide; and b) recovering one or more hydrocarbon product streams, directly from the second fraction, having less than 25 wppm of the hydrogen halide.

2. The process of claim 1, wherein the reactor is used for paraffin alkylation, olefin dimerization, olefin oligomerization, isomerization, aromatic alkylation, or mixtures thereof.

3. The process of claim 1, wherein the reactor comprises anhydrous HCl.

4. The process of claim 1, wherein the one or more hydrocarbon product streams from the second fraction have less than 10 wppm of the hydrogen halide.

5. The process of claim 1, wherein the one or more hydrocarbon product streams from the second fraction have less than 5 wppm of the hydrogen halide.

6. The process of claim 1, wherein the one or more hydrocarbon product streams from the second fraction have less than 1 wppm of the hydrogen halide.

7. The process of claim 1, wherein the metal halide is aluminum chloride and the hydrogen halide is HCl.

8. The process of claim 1, wherein the one or more hydrocarbon product streams comprise an alkylate gasoline.

9. The process of claim 1, further comprising the step of recycling the first fraction back to the reactor.

10. The process of claim 1, wherein the one or more product streams comprise one or more isoparaffins, and the process further comprises recycling the one or more isoparaffins back to the reactor.

11. The process of claim 1, further comprising the step of separating a catalyst phase from the effluent before stripping or distilling the effluent.

12. The process of claim 1, wherein the process comprises a single step of stripping or distilling.

13. The process of claim 1, wherein the one or more hydrocarbon product streams comprise propane, butane, alkylate gasoline, or mixtures thereof.

14. The process of claim 1, wherein the one or more hydrocarbon product streams have less than 25 wppm hydrogen halide prior to any optional caustic treating.

15. The process of claim 1, wherein the metal halide is selected from the group consisting of $AlCl_3$, $AlBr_3$, $GaCl_3$, $GaBr_3$, $InCl_3$, $InBr_3$, and mixtures thereof.

16. The process of claim 1, wherein the ionic liquid catalyst is selected from the group consisting of hydrocarbyl substituted pyridinium chloroaluminate, hydrocarbyl substituted imidazolium chloroaluminate, quaternary amine chloroaluminate, trialky amine hydrogen chloride chloroaluminate, alkyl pyridine hydrogen chloride chloroaluminate, and mixtures thereof.

17. The process of claim 16, wherein the ionic liquid catalyst is N-butylpyridinium chloroaluminate.

18. The process of claim 1, wherein the one of more hydrocarbon product streams are recovered in process equipment having poor corrosion resistance to HCl, and wherein the process equipment does not exhibit corrosion from the recovering.

19. A process for making hydrocarbon products with low hydrogen halide, comprising:

a) stripping or distilling an effluent from a reactor into a first fraction having an amount of a hydrogen halide, and a second fraction having a reduced amount of the hydrogen halide; wherein the stripping is a removal of volatile components from the effluent by vaporization; wherein the reactor comprises an ionic liquid catalyst having a metal halide; and b) recovering a propane, an n-butane, and an alkylate gasoline directly from the second fraction, all having less than 25 wppm of the hydrogen halide.

20. The process of claim 19, wherein the propane, the n-butane, and the alkylate gasoline all have less than 10 wppm of the hydrogen halide.

21. The process of claim 19, wherein the propane, the n-butane, and the alkylate gasoline all have less than 5 wppm of the hydrogen halide.

22. The process of claim 19, wherein the reactor additionally comprises a hydrogen halide or an organic halide.

23. A process for making hydrocarbon products with low hydrogen halide, comprising:

a) stripping or distilling an effluent from a reactor into a first fraction having an increased amount of a hydrogen halide, and a second fraction having a reduced amount of the hydrogen halide less than the first fraction; wherein the stripping is a removal of volatile components from the effluent by vaporization; wherein the reactor comprises:

i. an ionic liquid catalyst having a metal halide, and ii. the hydrogen halide or an organic halide; and b) recovering one or more hydrocarbon product streams, directly from the second fraction, using a distillation column comprising one or more metals having poor corrosion resistance to the hydrogen halide; and wherein the distillation column does not exhibit corrosion from the recovering.

24. The process of claim 23, wherein the one or more metals having poor corrosion resistance to the hydrogen halide comprise a carbon steel, a stainless steel, or a mixture thereof.

25. An alkylate gasoline having less than 5 wppm hydrogen halide, a RON greater than 90, and a RVP of 2.2 psi or less, made by a process comprising:

a) stripping or distilling an effluent from a reactor into a first fraction having an amount of a hydrogen halide, and a second fraction having a reduced amount of the hydrogen halide less than the first fraction; wherein the stripping is a removal of volatile components from the effluent by vaporization; wherein the reactor comprises:

i. an ionic liquid catalyst having a metal halide, and ii. the hydrogen halide or an organic halide; and b) recovering the alkylate gasoline directly from the second fraction.

26. The alkylate gasoline of claim 25, wherein the alkylate gasoline comprises less than 1 wppm hydrogen halide.

27. The alkylate gasoline of claim 25, wherein the process comprises recycling the first fraction back to the reactor.

28. The alkylate gasoline of claim 27, wherein the alkylate gasoline comprises less than 1 wppm hydrogen halide.

29. The process of claim 19, further comprising the step of recycling the first fraction back to the reactor.

30. The process of claim 23, further comprising the step of recycling the first fraction back to the reactor.

* * * * *